US009316170B2

(12) United States Patent
Song et al.

(10) Patent No.: US 9,316,170 B2
(45) Date of Patent: Apr. 19, 2016

(54) CONTROLLER INTEGRATED FUEL PUMP MODULE

(71) Applicants: Hyundai Motor Company, Seoul (KR); Kia Motors Corporation, Seoul (KR)

(72) Inventors: Ju Tae Song, Hwaseong-si (KR); Yeoun Kwan Sung, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 181 days.

(21) Appl. No.: 14/085,643

(22) Filed: Nov. 20, 2013

(65) Prior Publication Data

US 2014/0318646 A1 Oct. 30, 2014

(30) Foreign Application Priority Data

Apr. 30, 2013 (KR) ..... 10-2013-0048462

(51) Int. Cl.

| | |
|---|---|
| ***F02M 37/04*** | (2006.01) |
| ***F02D 41/30*** | (2006.01) |
| ***F02M 37/10*** | (2006.01) |
| ***F02D 33/00*** | (2006.01) |

(52) U.S. Cl.

CPC ..... *F02D 41/3082* (2013.01); *F02D 33/003* (2013.01); *F02M 37/103* (2013.01); *F02D 2200/0602* (2013.01); *F02D 2400/18* (2013.01); *F02D 2700/0282* (2013.01); *Y10T 137/8376* (2015.04)

(58) Field of Classification Search

CPC ..... F02M 37/103; F02M 37/106; F02M 2037/082; F02M 2037/085; F02D 2400/18

USPC ..... 123/509

See application file for complete search history.

(56) References Cited

U.S. PATENT DOCUMENTS

| | | | | |
|---|---|---|---|---|
| 5,454,697 | A * | 10/1995 | Nakanishi | 417/423.3 |
| 6,604,494 | B2 * | 8/2003 | Skrzypchak | F01P 3/12 123/41.31 |
| 7,314,040 | B2 * | 1/2008 | Yagi et al. | 123/509 |
| 7,411,326 | B2 * | 8/2008 | Achor et al. | 310/68 B |
| 7,458,365 | B2 * | 12/2008 | Hazama | 123/509 |
| 7,497,207 | B2 * | 3/2009 | Lahn et al. | 123/497 |
| 7,806,109 | B2 * | 10/2010 | Tateishi | B01D 35/027 123/509 |
| 7,808,784 | B2 * | 10/2010 | Graf | 361/704 |

(Continued)

FOREIGN PATENT DOCUMENTS

| | | |
|---|---|---|
| JP | 2001-214826 A | 8/2001 |
| JP | 2006-233955 A | 9/2006 |

(Continued)

*Primary Examiner* — Thomas Moulis

(74) *Attorney, Agent, or Firm* — Morgan, Lewis & Bockius LLP

(57) ABSTRACT

A controller integrated fuel pump module for a vehicle, may include a reservoir cup configured to be fixed to an interior of a fuel tank, a fuel pump installed in an interior of the reservoir cup to pump fuel introduced into the interior of the reservoir cup, and a flange for fixing the reservoir cup and the fuel pump to the fuel tank, wherein a receiving part may be formed to an outer surface of the flange and may include an inner space, and wherein a printed circuit board (PCB) assembly configured to mount devices of a controller to a PCB may be molded in the receiving part, in a state in which the PCB assembly may be received in the receiving part, and a molding portion surrounds the PCB assembly in the receiving part.

9 Claims, 3 Drawing Sheets

(56) References Cited

U.S. PATENT DOCUMENTS

| | | | | |
|---|---|---|---|---|
| 7,827,969 | B2 * | 11/2010 | Yamamoto et al. | 123/509 |
| 7,954,476 | B2 * | 6/2011 | Murakoshi et al. | 123/509 |
| 8,072,229 | B2 * | 12/2011 | Nakamura et al. | 324/663 |
| 8,869,775 | B2 * | 10/2014 | Maruyama et al. | 123/497 |
| 9,000,608 | B2 * | 4/2015 | Sakakibara | F02N 11/0862 307/10.1 |

FOREIGN PATENT DOCUMENTS

| | | | |
|---|---|---|---|
| JP | 4178354 | B2 | 9/2008 |
| JP | 2011-163212 | A | 8/2011 |
| JP | 2011-179409 | A | 9/2011 |
| KR | 10-2011-0067240 | A | 6/2011 |
| KR | 10-1103498 | B1 | 1/2012 |
| KR | 10-2012-0074177 | A | 7/2012 |

* cited by examiner

CONTROLLER INTEGRATED FUEL PUMP MODULE

CROSS-REFERENCE TO RELATED APPLICATION

The present application claims priority to Korean Patent Application No. 10-2013-0048462, filed on Apr. 30, 2013, the entire contents of which is incorporated herein for all purposes by this reference.

BACKGROUND OF THE INVENTION

1. Field of the Invention

The present invention relates to a fuel pump module for vehicles, and more particularly, to a fuel pump module for vehicles in which the total number of components and manufacturing costs can be reduced by eliminating components such as electrical wiring, a connector assembly, a controller housing, and a mounting bracket from a variable pressure control fuel pump system, and by which a motor applied voltage drop problem affecting a motor performance in addition to an electrical noise problem can be remedied.

2. Description of Related Art

As known in the art, a fuel pump module for feeding fuel stored in an interior of a fuel tank to an injector of an engine is installed in the fuel tank of a vehicle.

The fuel pump module may include a fuel pump, a filter for filtering fuel pumped by the fuel pump to eliminate impurities, a reservoir cup fixed to the fuel tank and having the fuel pump and the filter in an interior thereof, a bracket for fixing the fuel pump to the reservoir cup, a flange (or a holder cap) for fixing the fuel pump and the reservoir cup to the fuel tank.

The fuel pump module is configured to modularize the fuel pump, the reservoir cup, and the filter, and mounted to an interior of the fuel tank. A fuel pump of the fuel pump rotates an impeller to pump fuel introduced from the interior of the fuel tank into the reservoir cup, and then the pumped fuel is fed to the engine after impurities are eliminated through the filter.

In recent years, a variable pressure control fuel pump system may have been developed and is being applied in order to improve fuel efficiency of a vehicle, and this variable pressure control fuel pump system is a system which variably controls a supply pressure of fuel in real time in association with an operating state of the engine.

A pressure sensor for detecting the supply pressure of the fuel fed by the fuel pump is installed in the variable pressure control fuel pump system, and an actually measured current pressure detected by the pressure sensor is compared with a target pressure determined according to the operating state of the engine to feedback control the supply pressure of the fuel in real time.

FIG. 1 is a configuration view schematically showing a main configuration of the variable pressure control fuel pump system, and shows a battery 1 for supplying a actuating power source, a fuel pump module 2 fixedly installed in an interior of the fuel tank, a pressure sensor 3 for detecting the supply pressure of the fuel supplied to the engine, a controller 4 for feedback controlling driving of the fuel pump (a pump motor), and an ECU 5 for determining the target pressure according to the operating state of the engine to transmit the target pressure to the controller 4 while receiving failure diagnosis information from the controller 4.

According to the related art, the pressure sensor 3 is installed in a fuel supply pipe connected from the fuel pump module 2 to the engine.

Meanwhile, in the variable pressure control fuel pump system according to the related art, the controller 4 is manufactured of separate components configured to build a printed circuit board (PCB) on which various devices are mounted in a housing, and is mounted to the fuel tank. A controller mounting bracket for fixing the controller to the fuel tank is needed.

In addition, complex electrical wiring and connectors for electrically connecting the controller and the fuel pump are needed, and components such as a clamp for fixing the electrical wiring to the circumference of the fuel tank are needed.

In this way, costs of the system increase as a configuration of the variable pressure control fuel pump system is complex and the number of components such as a connector assembly, a controller housing, and a mounting bracket increases. Accordingly, it is difficult to extend and apply the system to luxury vehicles to middle-sized or small-sized vehicles.

Further, switching noise of switching devices in the controller are radiated to be transmitted through the electrical wiring, and the electrical wiring between the controller and the fuel pump becomes longer, causing severe electrical noise.

Further, a performance of the fuel pump (a DC motor) is proportional to an applied voltage, in which case the electrical wiring between the controller and the fuel pump becomes longer, causing a voltage drop (0.1 V~0.2 V) and thus deterioration of a performance of the motor.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a fuel pump module for vehicles in which the number of components and manufacturing costs can be reduced by eliminating components such as electrical wiring, a connector assembly, a controller housing, and a mounting bracket from a variable pressure control fuel pump system, and by which a motor applied voltage drop problem affecting a motor performance in addition to an electrical noise problem can be improved.

In accordance with an aspect of the present invention, a controller integrated fuel pump module for a vehicle may include a reservoir cup configured to be fixed to an interior of a fuel tank, a fuel pump installed in an interior of the reservoir cup to pump fuel introduced into the interior of the reservoir cup, and a flange for fixing the reservoir cup and the fuel pump to the fuel tank, wherein a receiving part is formed to an outer surface of the flange and may include an inner space, and wherein a printed circuit board (PCB) assembly configured to mount devices of a controller to a PCB is molded in the receiving part, in a state in which the PCB assembly is received in the receiving part, and a molding portion surrounds the PCB assembly in the receiving part.

A connector unit for connecting terminals to the outside of the fuel pump, a supply port portion for discharging the fuel pumped by the fuel pump to feed the fuel to an engine, and the receiving part are formed to the flange monolithically.

A connector unit for connecting terminals to the outside of the fuel pump is formed in the flange, wherein first ends of the terminals are connected to an inner side of the connector unit to be connected to the outside, second ends of the terminals are connected to the PCB, and remaining portions of the terminals except for both the first and second ends are buried in the connector unit and the receiving part.

Terminals for outputting gauge signals of a float gauge are installed at the connector unit, wherein first ends of the terminals for outputting the gauge signals are connected to an inner side of the connector to be connected to the outside, and wherein second ends of the terminals for outputting the gauge signals are provided to pass through the flange so as to be connected to the float gauge which is disposed at an inner side of the fuel tank, and remaining portions of the terminals expect for both the first and second ends are buried in the connector unit and the receiving part.

Terminals are installed in the connector unit, the terminals including a terminal for receiving a battery power source, a terminal for inputting signals of a pressure sensor for detecting supply pressure of fuel, and a terminal for communicating with an ECU (engine control unit).

A supply port portion for discharging the fuel pumped by the fuel pump to feed the fuel to an engine is formed in the flange, and a pressure sensor for detecting a supply pressure of the fuel is installed at the supply port portion.

A terminal for connecting the PCB assembly to the fuel pump is installed at the PCB assembly, a first end of the terminal is connected to the PCB, a second end thereof is provided to pass through the flange so as to be connected to the fuel pump disposed at an inner side of the fuel tank, and a remaining portion of the terminal except for the both first and second ends is buried in the molding portion disposed in the receiving part.

In a state in which a molding liquid injection hole is formed at the PCB and the PCB assembly is received in the receiving part, the molding liquid is injected to a lower side of the PCB assembly through the molding liquid injection hole, and the molding portion surrounds upper and lower sides of the PCB assembly disposed in the receiving part.

A heat dissipation member one end of which is connected to the PCB and an opposite end of which is exposed to an outer side of the molding portion is installed in the PCB assembly to discharge heat, wherein the heat dissipation member is installed to contact a rear surface of the PCB on which switching devices of the PCB are mounted.

The reservoir cup and the flange are connected by an elastic member.

Accordingly, the present invention provides a controller integrated fuel pump module where a PCB assembly formed of various devices and PCBs is fixedly molded by a molding material after being received in a space of a receiving part of a flange, and a molding portion surrounding the PCB assembly serves as a housing of an existing controller while a terminal integrally buried in the molding portion and the flange serves as electrical wiring of the existing controller.

Thus, as compared with the related art in which the controller is provided as a separate component and mounted to a fuel tank, complex and long electrical wiring and connectors of the electrical wiring can be eliminated, and since components for fixing electrical wiring such as the controller housing, the mounting bracket, and the clamp can be eliminated, the number of components and manufacturing costs can be reduced.

Further, since a process of connecting and fixing complex electrical wiring is omitted when the tank and the pump module are assembled, assembly efficiency and work efficiency can be improved, and the system is more concisely and more compactly configured than a system in which electrical wiring having complex outer appearance is connected to devices.

Further, problems generated due to complex and long electrical wiring according to the related art, that is, the excessive electrical noise generation and the motor applied voltage drop problem can be improved.

The methods and apparatuses of the present invention may have other features and advantages which will be apparent from or are set forth in more detail in the accompanying drawings, which are incorporated herein, and the following Detailed Description, which together serve to explain certain principles of the present invention.

Figure 1:
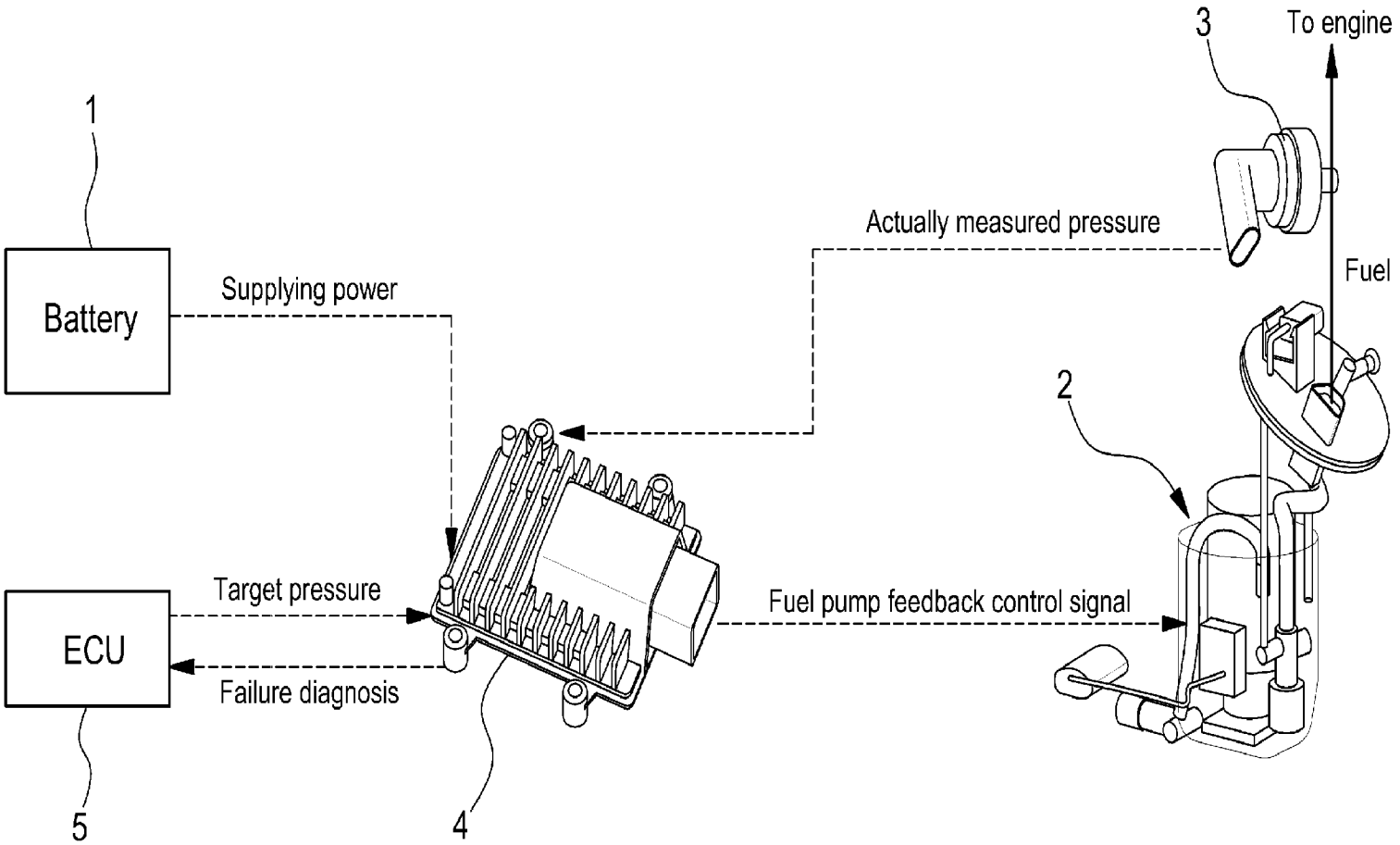
FIG. 1 is a diagram schematically showing a main configuration of a conventional variable pressure control fuel pump system.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be may include d within the spirit and scope of the invention as defined by the appended claims.

Hereinafter, an exemplary embodiment of the present invention will be described in detail with reference to the accompanying drawings so that those skilled in the art can easily carry out the present invention.

A fuel pump module according to an exemplary embodiment of the present invention may have a controller integrated structure configured by integrally molding and receiving main components of an existing controller at a receiving part of a flange assembled to be exposed to an outer side of a fuel tank.

Through the controller integrated structure, as compared with a structure according to the related art in which the controller is provided as a separate component and is mounted to the fuel tank, long electrical wiring between the controller and a pump motor, and a connector for connecting the electrical wiring may be eliminated, and the number of components and manufacturing costs may be reduced by eliminating components such as a controller housing and a mounting bracket.

Further, the fuel pump module according to an exemplary embodiment of the present invention may have a configuration in which a pressure sensor is integrally mounted to the flange, such a sensor integrated module may be usefully applied to a variable pressure control fuel pump system which compares an actually measured current pressure with a target pressure to feedback control the supply pressure of the fuel in real time.

Figure 2:
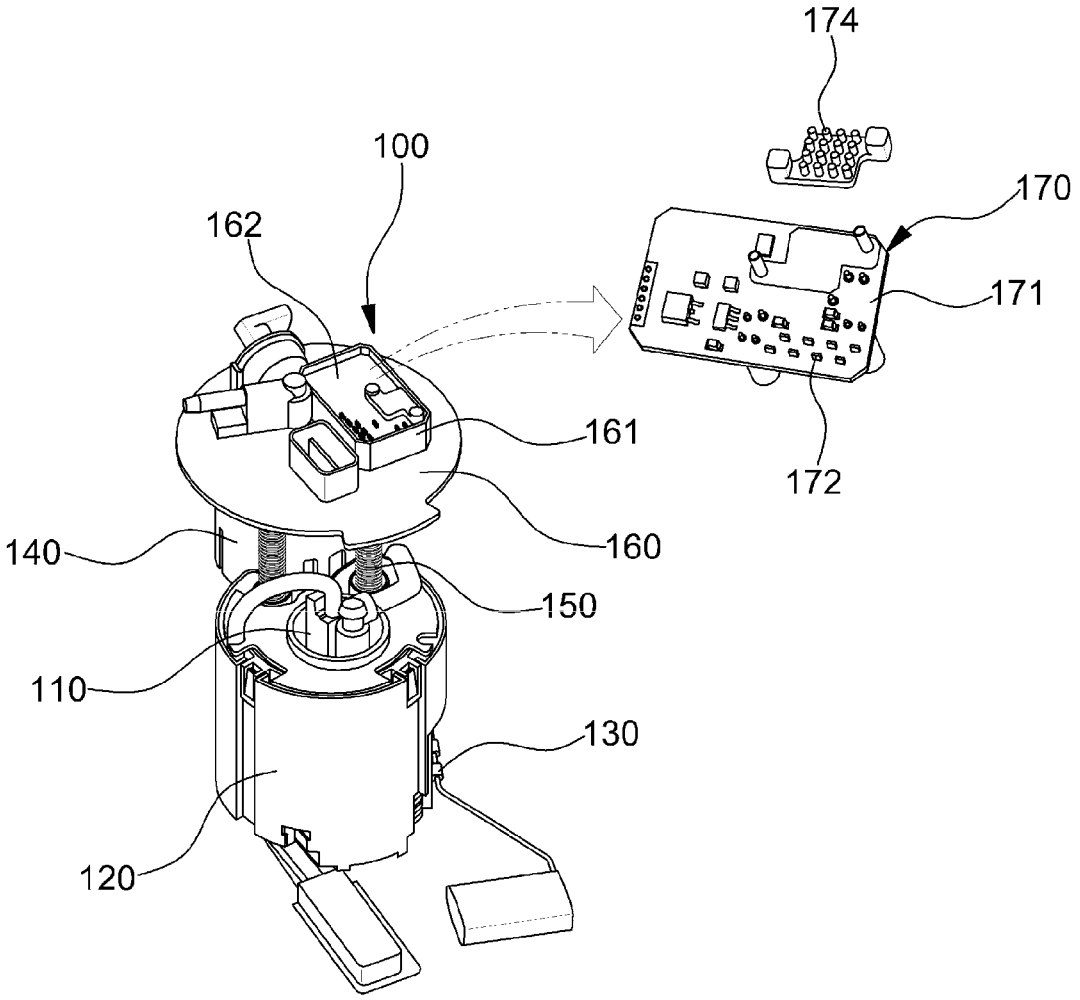
FIG. 2 is a perspective view showing a fuel pump module according to an exemplary embodiment of the present invention.
Figure 3:
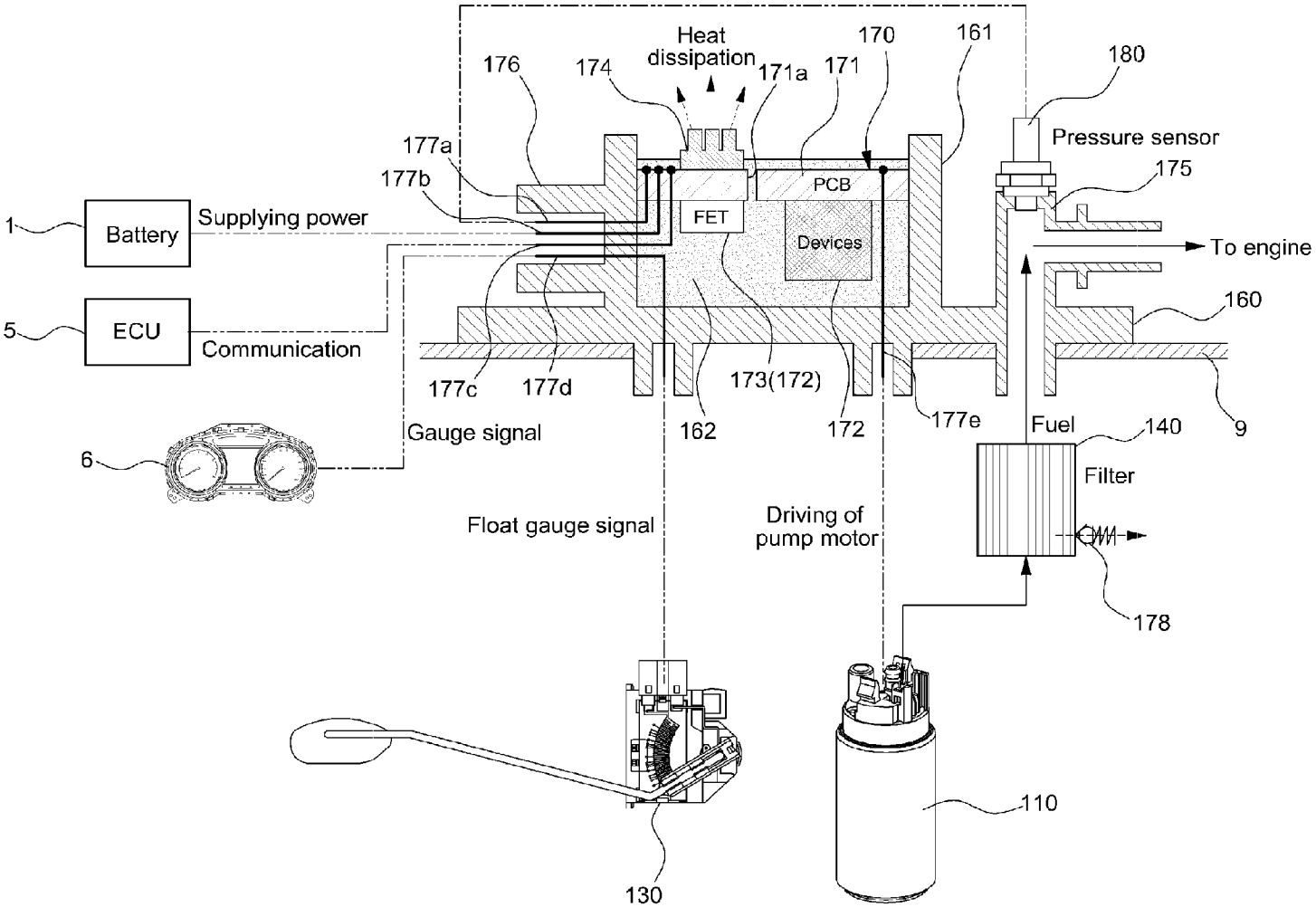
FIG. 3 is a sectional view showing a controller integrated structure of the fuel pump module according to the exemplary embodiment of the present invention.

FIG. 2 is a perspective view showing a fuel pump module according to an exemplary embodiment of the present invention, and FIG. 3 is a sectional view showing the controller integrated structure of the fuel pump module according to the exemplary embodiment of the present invention.

In the fuel pump module shown in FIG. 2, reference numeral 110 denotes the fuel pump such as pump motor, reference numeral 120 denotes a reservoir cup, and reference numeral 130 denotes a float gauge for detecting a fuel level in the fuel tank.

Further, reference numeral 140 denotes a filter for eliminating impurities in the fuel, and reference numeral 160 denotes a flange assembled to the fuel tank.

The flange 160 is a plate-shaped component for fixing components of the fuel pump module 100 including the reservoir cup 120 and the fuel pump 110 to the fuel tank. The flange 160 is assembled to block a hole of the fuel tank from an exterior of the fuel tank (reference numeral 9 in FIG. 3), and may have a surface exposed to the exterior of the fuel tank. The surface of the flange 160 exposed to the exterior of the fuel tank is a portion in which the controller (a PCB assembly which will be described below) is integrally buried.

The reservoir cup 120 and the flange 160 may be connected to each other by a damper 150 which can reduce impacts or vibrations transmitted upward and downward, and the damper 150 serves to damp impacts or vibrations while allowing a constant stroke of the reservoir cup 120 against the flange 160 fixed to the fuel tank.

First, in the fuel pump module 100 of the present invention, a PCB 171 of the controller to which various devices 172 are mounted is molded and sealed while being received in a receiving part 161 formed in the flange 161 so that the controller integrated structure where the controller is integrally mounted in the flange is applied.

Here, in a configuration in which the various devices 172 are mounted on the PCB 171 (a substrate), the PCB assembly 170 fixedly molded in the flange 160 performs a function of the controller of the variable pressure control fuel pump system, and the various devices 172 mounted on the PCB 171 may include devices of an existing controller for controlling driving of the fuel pump, including a switching device 173 (FET and the like).

A supply port portion 175 for discharging fuel pumped by the fuel pump system through the filter 140 and feeding the fuel to the engine is formed at one side of the flange 160 fixed to the fuel tank 9, and a pressure sensor 180 is installed in the supply port portion 175 (see FIG. 3).

An entrance of the supply port portion 175 is inserted into the fuel tank 9 to be connected to an exit of the filter 140, and a fuel hose for feeding the fuel to the engine is connected to an exit of the supply port portion 175.

Accordingly, since the fuel pump module according to an exemplary embodiment of the present invention may have a configuration in which components of the variable pressure control system such as the controller and the pressure sensor are integrated, all of existing electrical wiring, a connector assembly, a controller housing, and a controller mounting bracket may be eliminated.

The flange 160 according to an exemplary embodiment of the present invention is a resin injection-molded product manufactured by injection-molding resin, and may have a housing-shaped receiving part 161 for receiving the PCB assembly 170 as shown in FIG. 3.

Then, the PCB assembly 170 is molded and sealed without an external exposure while being received in the receiving part 161 of the flange 160, and since a molding material portion (hereinafter, referred to as a molding portion) seals a periphery of the PCB assembly 170, the PCB 171 can be safely fixed to the receiving part 161 of the flange 160.

Further, as shown in FIG. 3, since all of upper and lower sides of the PCB assembly 170 mounted in the receiving part 161 of the flange 160 should be molded by a molding product, the molding portion 162 surrounds both of upper and lower sides of the PCB assembly 170 by injecting molding liquid toward a lower side of the PCB 171 through a molding liquid injection hole 171*a* after the molding liquid injection hole 171*a* is formed at the PCB 171.

The formed molding portion 162 electrically insulates the PCB assembly 170 from the outside, isolates the PCB assembly 170 from external environment such as temperature and humidity, and maintains the isolation state such that moisture and foreign substances cannot enter the PCB assembly 170. In addition, the molding portion 162 serves to insulate the PCB assembly 170 from vibration of a vehicle.

A resin known as a molding material for electronic products or an electric insulation material may be used as a molding material. Although the molding material is not specifically limited in an exemplary embodiment of the present invention, it is preferable to choose a heat-resisting material which may have an excellent adhesiveness for a flange material and does not generate a crack by heat, and to choose a material whose volume change is small when the fuel is deposited, considering that the material is used in the fuel pump module.

Meanwhile, a connector unit 176 for external connection is formed in the flange 160, and terminals 177*a* to 177*d* are installed at an inner side of the connector unit 176.

Then, the terminal 177*b* for supplying an electric power of the battery 1 to the connector unit 176, the terminal 177*a* for receiving signals of the pressure sensor 180, the terminal 177*c* for communicating with ECU 5, and the terminal 177*d* for outputting gauge signals of the float gauge 130 to transmit the signal to a cluster 6 are installed.

Ends of each of the terminals 177*a* to 177*d* are connected to an inner side of the connector unit 176 to connect outside, and the other ends of each of the terminals 177*a* to 177*c* for connecting to the battery 1, the pressure sensor 180, and the ECU 5 are connected to the PCB 171 through soldering or press-fitting while being buried in the molding portion 162 located in the connector unit 176 and the receiving part 161.

However, the electrically sensitive float gauge terminal 177*d*, that is, the terminal 177*d* for outputting the gauge signal is not connected to the PCB 171, and the other end of the terminal 177*d* is provided to pass through the flange 160 to be connected to the float gauge 130 located at inner side of the fuel tank 9 while being buried in the molding portion 162 located in the connector unit 176 and the receiving part 161.

In this way, the remaining portions of each of the terminals 177*a* to 177*d* except for both ends of them are buried in the molding portion 162 and the flange 160 to be fixed to the molding portion 162 and the flange 160.

Further, a terminal 177*e* for connecting the PCB assembly 170 to the fuel pump 110 is separately installed. One end of the terminal 177*e* is connected to the PCB 171 through soldering or press-fitting, and an opposite end thereof is provided to pass through the flange 160 to be connected to the fuel pump 110 while being buried in the molding portion 162.

Thus, the terminal 177*e* for connecting the fuel pump 110 is buried in the molding portion 162 and the flange 160 to be fixed to the molding portion 162 and the flange 160.

As described above, the PCB assembly 170 is electrically connected to the battery 1, the pressure sensor 180, the ECU 5, and the fuel pump 110 through the terminals, thereby performing variable pressure controls. The description of the variable pressure control will be omitted since it is the technical details known to those skilled in the art.

A heat dissipation member 174 for discharging heat to the outside is installed on the PCB assembly 170, and the heat dissipation member 174 is installed to contact a rear side (As shown in drawings, an upper surface of the PCB when devices are mounted on a lower surface of the PCB) of a surface on which devices are mounted.

In particular, since the switching device 173 (FET and the like) is a portion emitting much heat, the heat dissipation member 174 is preferably installed on a rear surface of a portion on which the switching device 173 is installed. Then, one side of the heat dissipation member 174 is installed to be exposed to the outside of the molding portion 162 while an opposite side of the heat dissipation member 174 contacts the PCB 171, making it possible to discharge heat into the air through the exposed portion.

Further, since the heat dissipation member 174 is a member for effectively discharging heat generated from the PCB assembly 170 to the outside, the heat dissipation member 174 is preferably manufactured of a material having high thermal conductivity. A portion which corresponds to a surface of the PCB 171 to a middle-height of the heat dissipation member 174 is sealed by the molding portion 162, and a remaining portion of the heat dissipation member 174 is provided to be exposed to the outside.

In FIG. 3, reference numeral 178 denotes a pressure regulator 178 mounted on a fuel supply line. When an unintended high pressure is generated in the pipe when the fuel is fed to the engine through the filter 140 by driving of the fuel pump 110, the fuel returns to the interior of the fuel tank 9 through the pressure regulator 178.

Accordingly, the present invention provides a controller integrated fuel pump module where a PCB assembly formed of various devices and PCBs is fixedly molded by a molding material after being received in a space of a receiving part of a flange, and a molding portion surrounding the PCB assembly serves as a housing of an existing controller while a terminal integrally buried in the molding portion and the flange serves as electrical wiring of the existing controller.

In another aspect of the present invention, the connector unit 176 for connecting terminals 177*a*, 177*b*, 177*c*, and 177*d* to the outside of the fuel pump 110, the supply port portion 175 for discharging fuel pumped by the fuel pump 110 to feed the fuel to an engine, and the receiving part 161 are formed to the flange 160 monolithically.

Thus, as compared with the related art in which the controller is provided as a separate component and mounted to a fuel tank, complex and long electrical wiring and connectors of the electrical wiring can be eliminated, and since components for fixing electrical wiring such as the controller housing, the mounting bracket, and the clamp can be eliminated, the number of components and manufacturing costs can be reduced.

Further, since a process of connecting and fixing complex electrical wiring is omitted when the tank and the pump module are assembled, assembly efficiency and work efficiency can be improved, and the system is more concisely and more compactly configured than a system in which electrical wiring having complex outer appearance is connected to devices.

Further, problems generated due to complex and long electrical wiring according to the related art, that is, the excessive electrical noise generation and the motor applied voltage drop problem can be improved.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention may have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A controller integrated fuel pump module for a vehicle, comprising a reservoir cup configured to be fixed to an interior of a fuel tank, a fuel pump installed in an interior of the reservoir cup to pump fuel introduced into the interior of the reservoir cup, and a flange for fixing the reservoir cup and the fuel pump to the fuel tank, wherein a receiving part is formed to an outer surface of the flange and may include includes an inner space, and wherein a printed circuit board (PCB) assembly configured to mount devices of a controller to a PCB is molded in the receiving part, in a state in which the PCB assembly is received in the receiving part, and a molding portion surrounds the PCB assembly in the receiving part, wherein a connector unit for connecting terminals to the outside of the fuel pump is formed in the flange, wherein first ends of the terminals are connected to an inner side of the connector unit to be connected to the outside, second ends of the terminals are connected to the PCB, and remaining portions of the terminals except for both the first and second ends are buried in the connector unit and the receiving part, wherein terminals for outputting gauge signals of a float gauge are installed at the connector unit, wherein first ends of the terminals for outputting the gauge signals are connected to an inner side of the connector to be connected to the outside, and wherein second ends of the terminals for outputting the gauge signals are provided to pass through the flange so as to be connected to the float gauge which is disposed at an inner side of the fuel tank, and remaining portions of the terminals expect for both the first and second ends are buried in the connector unit and the receiving part.

2. The controller integrated fuel pump module of claim 1, wherein the connector unit for connecting the terminals to the outside of the fuel pump, a supply port portion for discharging the fuel pumped by the fuel pump to feed the fuel to an engine, and the receiving part are formed to the flange monolithically.

3. The controller integrated fuel pump module of claim 1, the terminals including:

a terminal for receiving a battery power source, a terminal for inputting signals of a pressure sensor for detecting supply pressure of fuel, and a terminal for communicating with an Engine Control Unit.

4. The controller integrated fuel pump module of claim 1, wherein a supply port portion for discharging the fuel pumped by the fuel pump to feed the fuel to an engine is formed in the flange, and a pressure sensor for detecting a supply pressure of the fuel is installed at the supply port portion.

5. The controller integrated fuel pump module of claim 1, wherein a terminal for connecting the PCB assembly to the fuel pump is installed at the PCB assembly, a first end of the terminal is connected to the PCB, a second end thereof is provided to pass through the flange so as to be connected to the fuel pump disposed at an inner side of the fuel tank, and a remaining portion of the terminal except for the both first and second ends is buried in the molding portion disposed in the receiving part.

6. The controller integrated fuel pump module of claim 1, wherein, in a state in which a molding liquid injection hole is formed at the PCB and the PCB assembly is received in the receiving part, the molding liquid is injected to a lower side of the PCB assembly through the molding liquid injection hole, and the molding portion surrounds upper and lower sides of the PCB assembly disposed in the receiving part.

7. The controller integrated fuel pump module of claim 1, wherein a heat dissipation member, one end of which is connected to the PCB and an opposite end of which is exposed to an outer side of the molding portion, is installed in the PCB assembly to discharge heat.

8. The controller integrated fuel pump module of claim 7, wherein the heat dissipation member is installed to contact a rear surface of the PCB on which switching devices of the PCB are mounted.

9. The controller integrated fuel pump module of claim 1, wherein the reservoir cup and the flange are connected by an elastic member.

* * * * *